US006032365A

United States Patent [19]

Hodges

[11] Patent Number: 6,032,365

[45] Date of Patent: Mar. 7, 2000

[54] SLOTTED ROTARY SHAVER

[75] Inventor: James L. Hodges, 105 W. Camebrake Blvd., Hattiesburg, Miss. 39402

[73] Assignee: James L. Hodges, Hattiesburg, Miss.

[21] Appl. No.: 09/025,460

[22] Filed: Feb. 18, 1998

Related U.S. Application Data

[60] Provisional application No. 60/039,098, Feb. 24, 1997.

[51] Int. Cl.[7] ..... B26B 19/14

[52] U.S. Cl. ..... 30/43.6; 30/50; 30/43.92; 30/346.51

[58] Field of Search ..... 30/34.1, 43.6, 30/43.92, 34.05, 50, 346.51

[56] References Cited

U.S. PATENT DOCUMENTS

| | | | |
|---|---|---|---|
| 2,119,284 | 5/1938 | Meyer | 30/43 |
| 2,982,021 | 5/1961 | Miller | 30/43 |
| 3,261,097 | 7/1966 | Ritter | 30/354 |
| 4,180,906 | 1/1980 | May | 30/42 |
| 4,294,010 | 10/1981 | Chen et al. | 30/42 |
| 4,393,586 | 7/1983 | Hamashima et al. | 30/43.6 |
| 4,635,360 | 1/1987 | Tanahashi et al. | 30/43.6 X |
| 4,675,998 | 6/1987 | Thijsse | 30/43.6 |
| 4,964,214 | 10/1990 | Welsh et al. | 30/49 |
| 5,007,168 | 4/1991 | Messinger et al. | 30/43 |
| 5,119,558 | 6/1992 | Van Erp et al. | 30/43.6 |
| 5,153,992 | 10/1992 | Brown et al. | 30/49 |
| 5,301,425 | 4/1994 | Ferraro | 30/42 |
| 5,394,611 | 3/1995 | Okabe et al. | 30/43.6 |
| 5,408,749 | 4/1995 | Momose | 30/43.6 |
| 5,483,745 | 1/1996 | Izumi | 30/43.6 |
| 5,687,481 | 11/1997 | De Boer et al. | 30/43.6 X |

*Primary Examiner*—M. Rachuba
*Assistant Examiner*—T. Anthony Vaughn

[57] ABSTRACT

An electrically powered slotted rotary shaver which provides the clean, close shave of a hand-held razor combined with the safety, comfort and convenience of an electric shaver. The slotted rotary shaver comprises a body portion and a shaving portion. The head portion is provided with one or more shaving head assemblies having fixed upper grids and lower rotary grids. The upper grids are positioned upon a shaft extending from motor positioned within the body portion of the shaver. The upper grids are advantageously separated into four pie-shaped quadrants held together at the center by a pivot point, and comprise a plurality of apertures disposed over the high surface active cutting area of the upper grid through which hair protrudes when the head portion of the shaver is placed against a user's skin. The edges of each quadrant of the upper rotary grid also include sharpened blades which are arranged diametrically opposite one another to define slots through which long and/or curly hair, as well as previously cut stubble protrudes when the head portion of the shaver is placed against the user's skin. The lower rotary grid which includes openings thereon, is disposed on motor shaft below the upper grid and is planerized through opposite magnetized polarity such that when the shaver is activated, the lower rotary grids spin at high speeds in a continually reversing clockwise and counterclockwise directions upon the motor shaft to create a scissoring action which cuts the hair which has protruded through the apertures and slot of the upper rotary grid and the openings of the lower rotary grid when the shaving portion of the shaver is placed against a user's face.

14 Claims, 6 Drawing Sheets

Figure
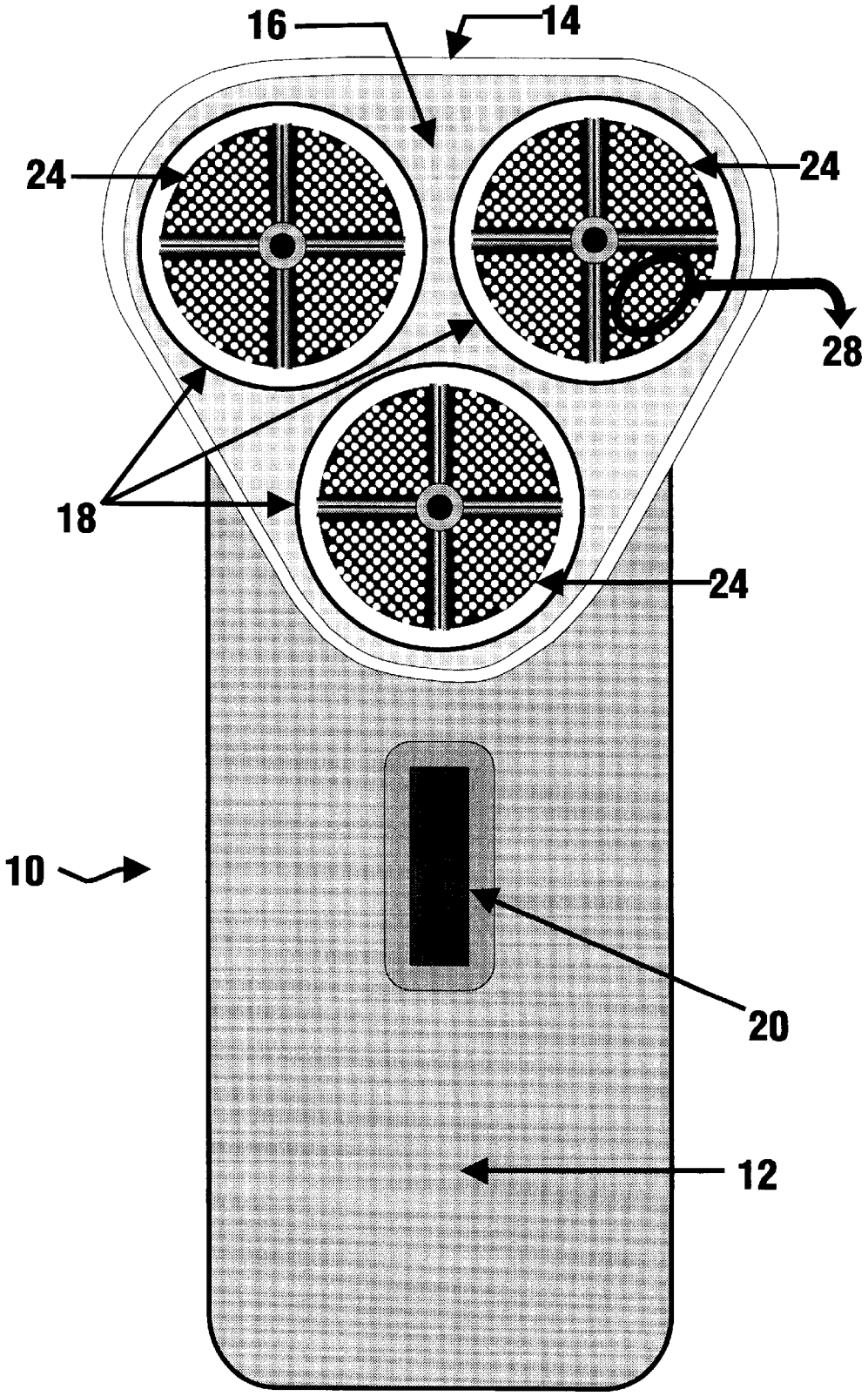

Figure
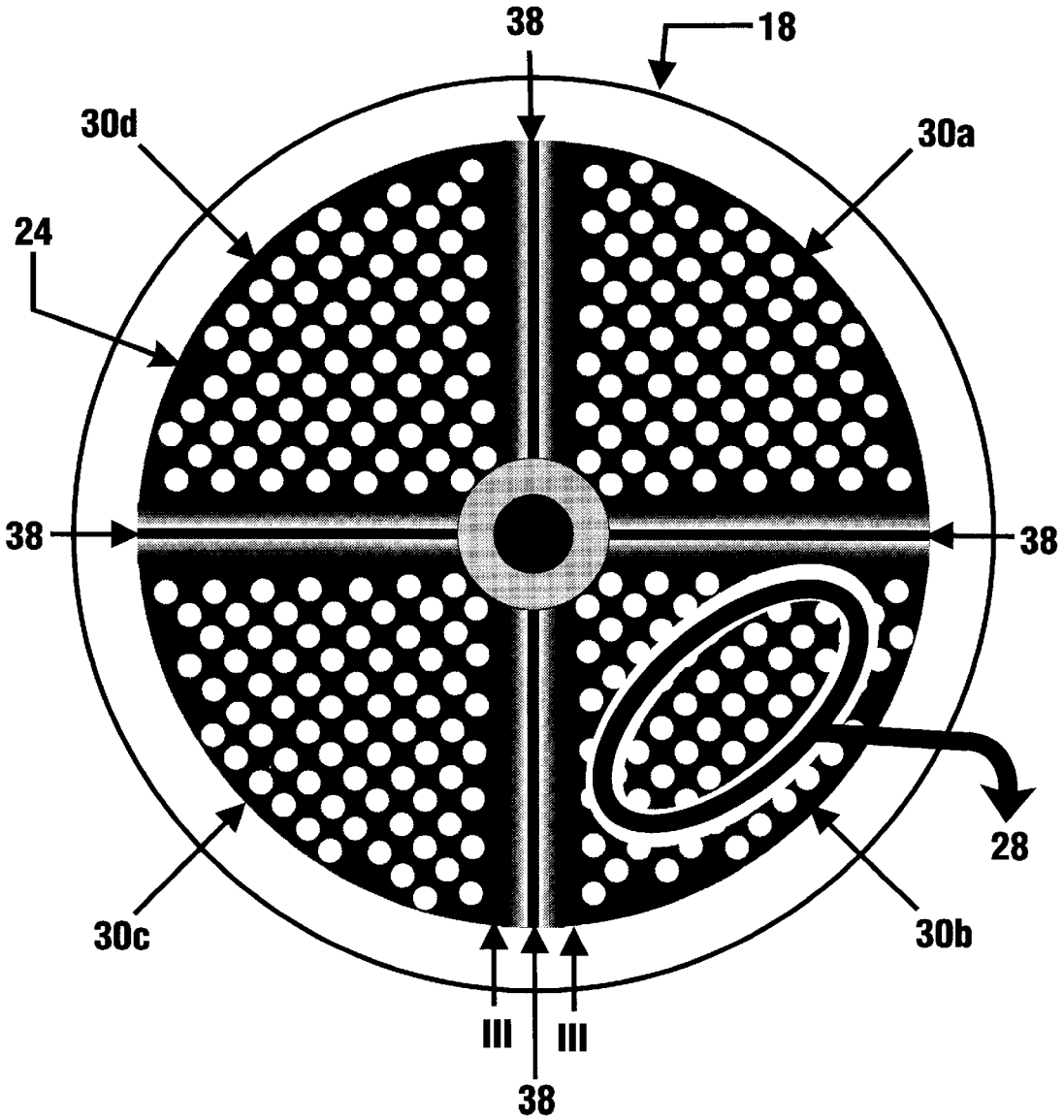

Figure
Simulated Cutting Slot 38 Cross Section (III-III)
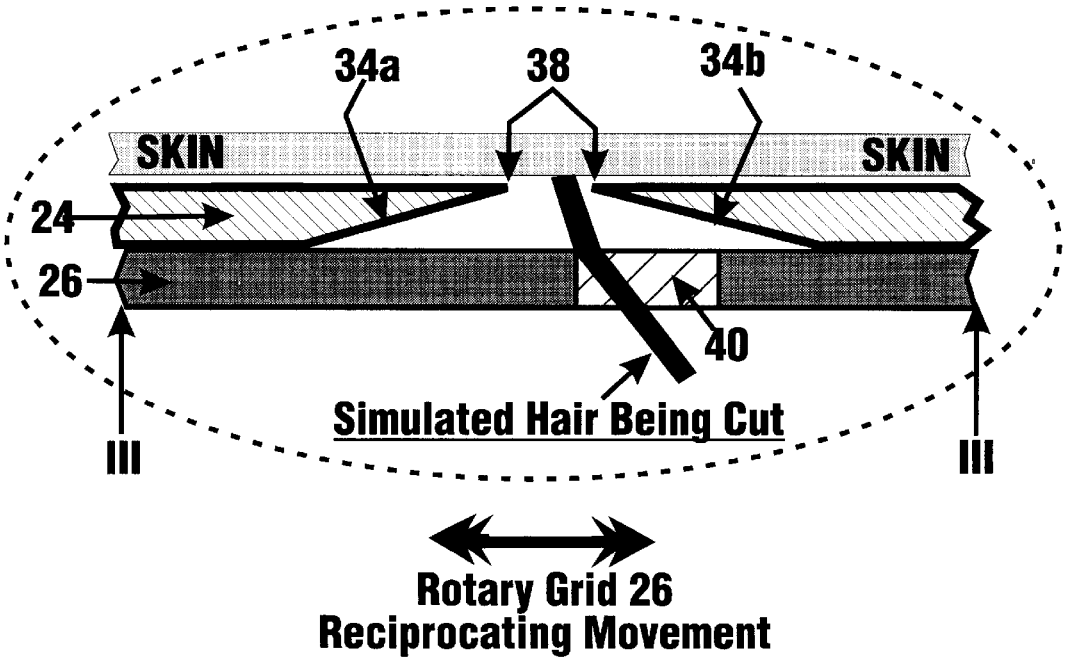

Figure
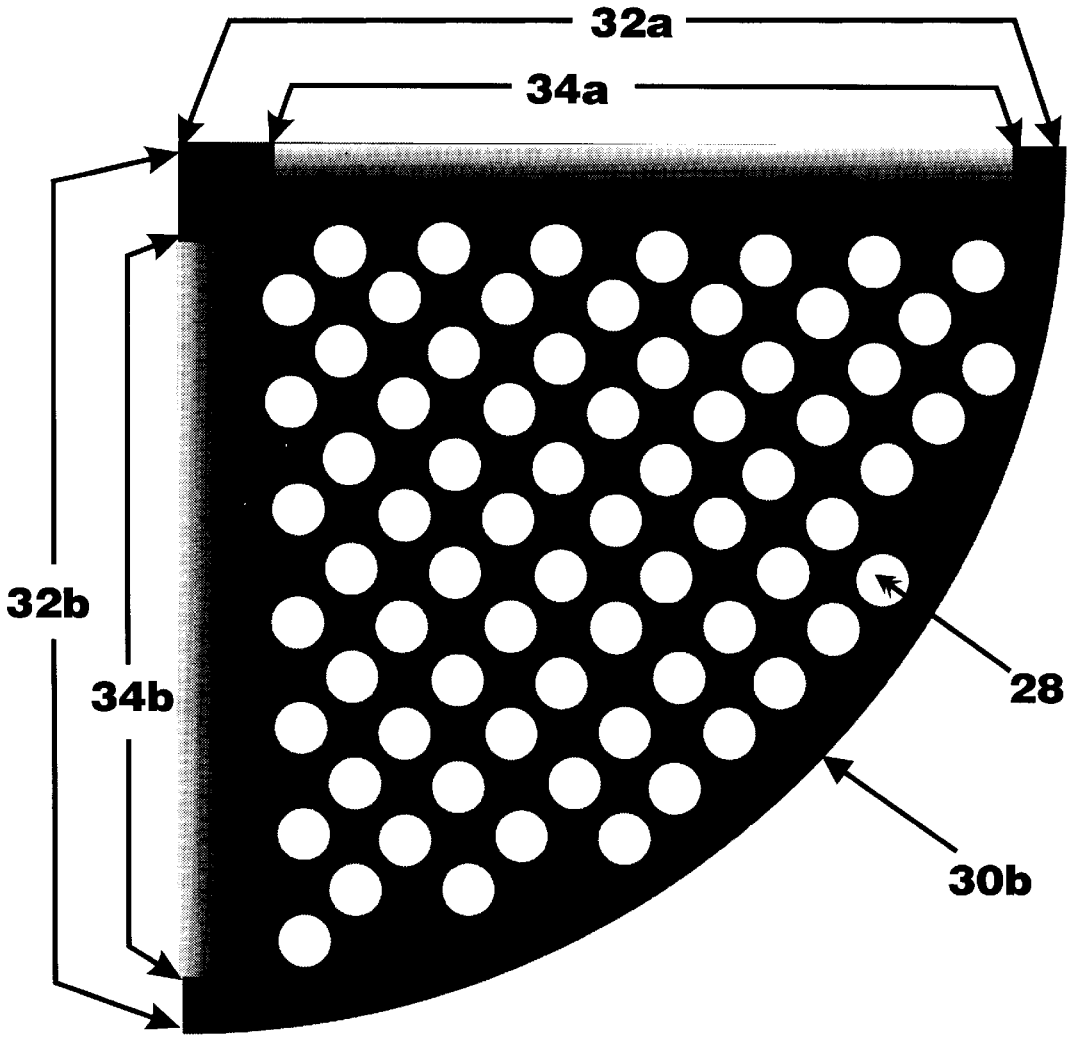

Figure
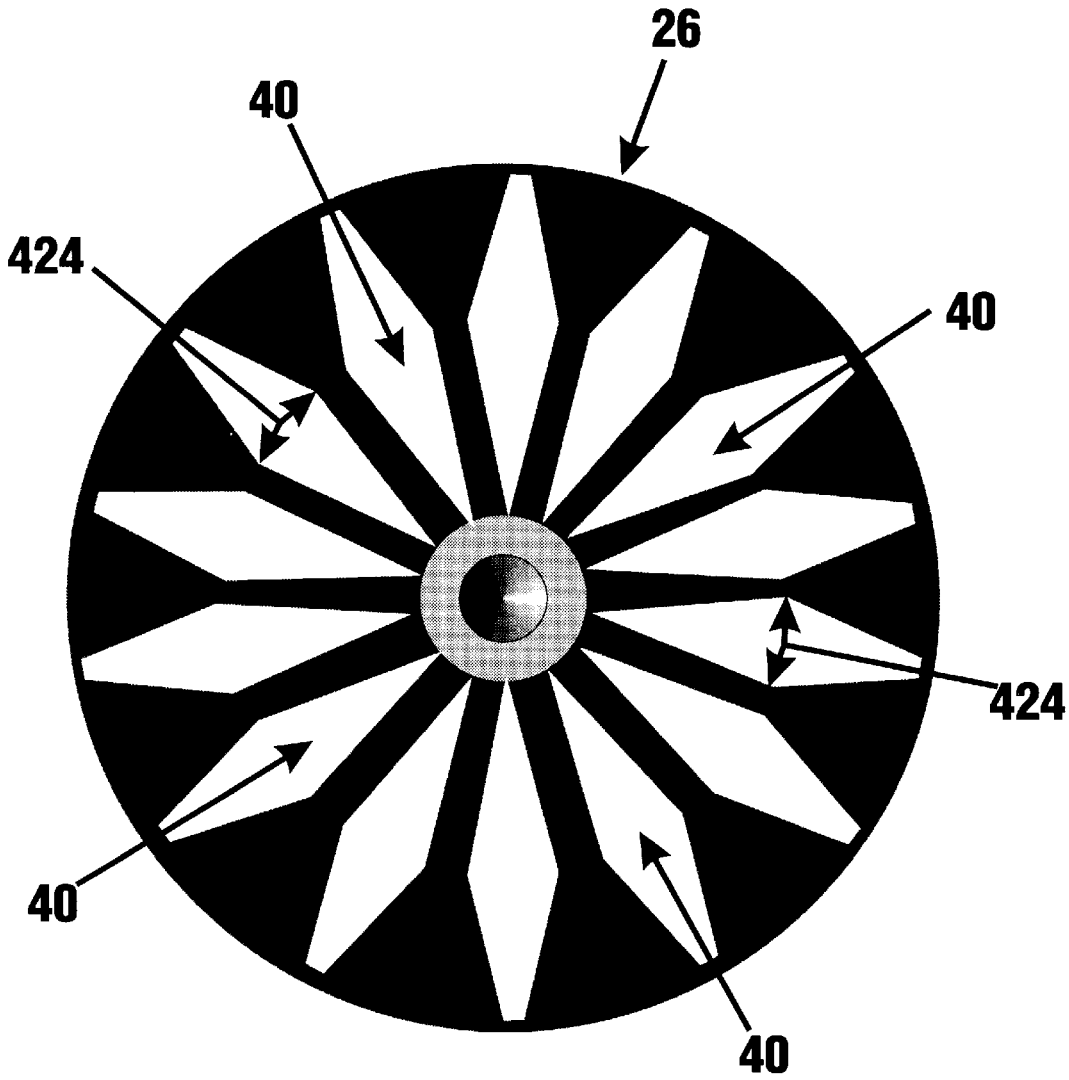

Figure
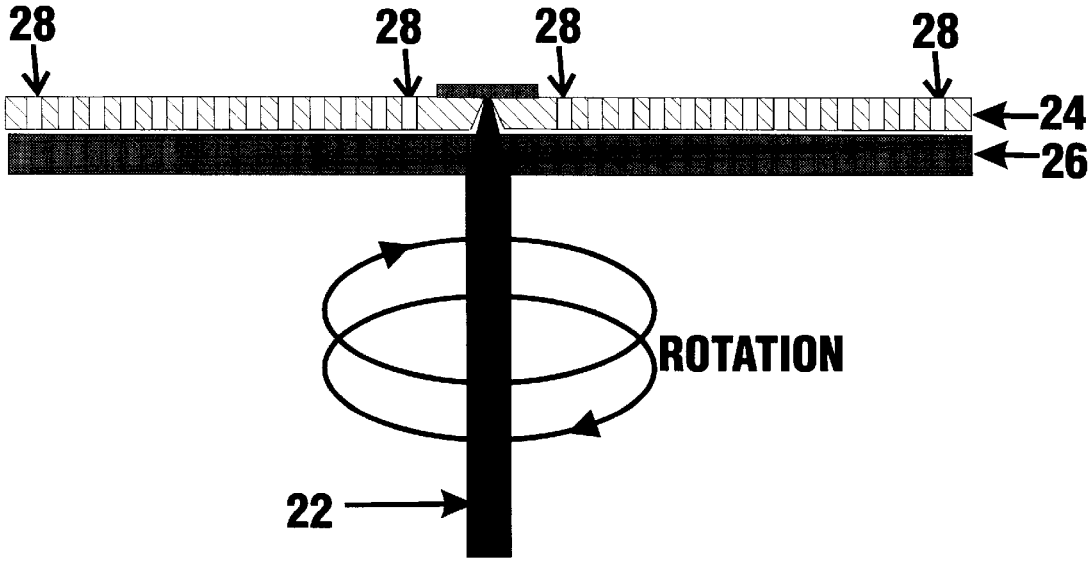

SLOTTED ROTARY SHAVER

CONTINUING DATA

Applicant claims the benefit of the priority date of provisional application Ser. No. 60/039,098 filed on Feb. 24, 1997.

FIELD OF THE INVENTION

This invention relates to shaving devices, and more particularly to an electrically-powered slotted rotary shaver which provides near razor shaving closeness while providing a large cutting surface area for efficient, irritation-free close shaving with an electric shaver.

BACKGROUND OF THE INVENTION

In the past, men and women have generally utilized hand held razors or electric shavers in an attempt to remove unwanted body hair and to obtain a clean, close shave. Single straight edged blades and single or double blade hand-held razors have been widely used for many years and generally provide a smooth, clean, and close shave. However, many men disfavor or in some instances completely avoid, straight edged blades or hand held razors since the blade must be applied directly to the face thus creating the risk of easily cutting the skin. Women, when shaving their legs, have also avoided straight edged blades or hand held razors due to the risk of painful nicks and cuts and the unsightly scabs and scars which may result therefrom. Additionally, many more women avoid using straight edged blades or hand held razors when shaving under their arms since the arched and curved anatomical configuration of the underarm makes it extremely difficult to obtain a close shave using a straight edged or hand held razor. Furthermore, using hand-held razors can be expensive because the blades wear out after repeated use and need to be replaced on a regular basis. Hand-held razors also require the use of shaving cremes, gels or lotions, which can be expensive, and are required to be applied to the skin before shaving in order to reduce the friction created by the blade which is drawn over the surface of the skin.

Many men and women use electric shavers instead of or in addition to hand-held razors. Unlike hand-held razors, electric shavers, for the most part, have eliminated the problem of cutting the skin since a blade never comes into direct contact with the user's skin. Electric shavers are generally of two types: rotary or grid. Rotary shavers generally comprise a hand-held body having a top portion which generally includes one or more circular heads having slits or holes therein. An electrically controlled rotatable blade or cutting device is usually disposed beneath the circular head. In current rotary shavers, the actual cutting area is a small percentage of the actual circular head. Electric grid shavers generally comprise a hand-held body with a fine metallic screen or grid covering on the shaving end which is applied to the user's skin. Unlike the circular heads of the electric rotary shaver, the grid of the conventional electric grid shaver comprises numerous small apertures into which the user's facial, leg or under arm hair protrude when the grid is applied to the respective body part and slid over the skin to be shaved. As with the rotary shaver, an electrically controlled blade of narrow area is positioned beneath the grid and cuts in a small area in relationship to the total head area.

When the circular heads or grid portion of the electric shavers are pressed against the user's skin, the hairs protrude into the slits or holes and are then cut or sheared by the blade or cutting service beneath the head or grid. However, since the blade is positioned within the circular head or grid and thus spaced at a head thickness distance away from the user's skin, electric shavers generally do not provide the desired smooth and close shave that most men and women desire. Lift and cut mechanisms have been utilized in some recently manufactured shavers to provide closer shaves. However, lift and cut shavers do not work efficiently with long and/or curly hairs and can cause discomfort to the user. The small slits or holes in the lift and cut shavers as well as in the circular heads or grids of conventional shavers often prevent the effective use of an electric shaver by one with long and/or curly facial, leg or underarm hair since the hairs have difficulty entering the holes. Additionally most electric shavers irritate the user's skin, often causing burns or rashes which can be extremely unpleasant. Furthermore, numerous African-American men are afflicted with a skin condition which almost completely prohibits them from using electric shavers at all.

Thus, there is a need for a shaving device which provides the clean, close shave of a razor blade with the safety of an electric shaver, and which is provided with a large, more efficient cutting surface area. Additionally, there is a need for a shaving device which does not cut or irritate the skin and which can be safely used by users with long or curly facial, leg or underarm hair. Furthermore, there is a need for a shaving device which is efficient, inexpensive and easy to use and clean.

OBJECTS AND SUMMARY OF THE INVENTION

It is thus a general object of the present invention to provide a shaving device which provides the clean, close shave of a hand-held razor combined with the safety of an electric shaver.

A more specific object of the present invention is to provide a shaving device which is electrically-powered and which combines the circular heads and the grid of the two most widely used conventional electric shavers with the blades of a hand-held razor to provide close, irritation free shaving for use on all male and female body parts.

It is another object of the present invention to provide an electrically-powered shaving device having circular heads with metallic grid-plate openings having a high effective cutting area and provided with multiple diametrically opposed single edged blades disposed.

It is another object of the present invention to provide an electrically-powered shaving device having circular grid covered heads upon which diametrically opposed single edged blades are disposed and which are of a size which provides for substantially greater cutting area efficiency over prior art electric shavers.

It is a further object of the present invention to provide an electrically-powered shaving device having circular grid covered heads upon which diametrically opposed single edged blades are disposed, the blades being so closely spaced so as not to cut the user's skin while providing the close shave of a hand-held razor in an electrically powered shaving device.

It is still a further object of the present invention to provide an electrically-powered shaving device which combines the circular heads and the grid of the two most widely used conventional electric shavers with the blades of a hand-held razor to provide close, irritation free shaving and which is lightweight, portable, easy to manufacture, use and clean, and inexpensive.

In accordance with one aspect of the present invention, a slotted rotary shaver in the form of an electrically-powered shaving device is disclosed for providing close, irritation free shaving and for providing the close shave afforded by a straight edged blade or hand-held razor along with the safety of a conventional electric rotary or grid shaver. The slotted rotary shaver is comprised of a body portion and a shaving portion. The shaving portion includes a plurality of rotary shaving heads disposed thereon and which come into contact with a user's skin during shaving.

The rotary shaving heads positioned on the shaving portion of the shaver are comprised of upper and lower grids of fine screen or metallic mylar material having a plurality of apertures through which hair protrudes when the rotary shaving heads are positioned against a user's skin. The upper grids of the rotary shaving heads are comprised multiple of slotted fixed grids and are advantageously provided with four quadrants, each quadrant being separated by a slot on the upper grid. Each slot is positioned 90° from each other, such that all the slots form four right angles on the grid. The slots are comprised of two diametrically opposed single edged blades spaced from each other at a distance approximately equivalent to 3–5 human hairs. As such, when the rotary heads are positioned against a user's skin, hair protrudes into the grid apertures as well as into the spaces formed by the four slots on the grids of the rotary heads. The lower rotating grid is positioned on the motor shaft below the upper grid of each rotary head on the shaving portion, and is planerized into a close scissoring action through opposite magnetized polarity. When the shaver is activated, via a switch on the body portion, lower grids move clockwise and counterclockwise alternately at high sonic speeds, resulting in the scissoring action which cuts at skin level long and/or curly hairs and some short stubble which protrude into the slots created by the diametrically opposed blades of the slots on the upper grids. While the lower grids are in action, the circular holes of the large area grid are cutting stubble. Thus, the total cutting area of the slotted rotary shaving head is larger in total active cutting surface than the rotary heads on prior art rotary shavers. As such, the rotary heads have an active grid covering which in conjunction the slot cutting area provides over 10 times the cutting area of conventional prior art electric shavers. Additionally, the slotted areas provide for significantly closer shaving of long and curly hair.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings.

DETAILED DESCRIPTION OF THE DRAWINGS

In the drawings in which like reference characters denote similar elements throughout the several views:

FIG. 1 illustrates a front elevation view of the slotted rotary shaver according to one embodiment of the present invention;

FIG. 2 illustrates an enlarged view of one slotted circular grid of the slotted rotary shaver according to one embodiment of the present invention;

FIG. 3 illustrates an enlarged view of the gap between the blades which comprise the slot on the upper grid of the fixed upper grid of the slotted rotary shaver according to one embodiment of the present invention and as viewed along line III—III of FIG. 2;

FIG. 4 illustrates an enlarged view of one quadrant of the circular upper grid of the rotary head of the slotted rotary shaver according to one embodiment of the present invention;

FIG. 5 illustrates an enlarged view of a lower rotary cutting grid according to one embodiment of the present invention; and FIG. 6 illustrates a side view of a circular rotary grid mounted on a motor shaft according to one embodiment of the present invention.

DETAILED DESCRIPTION OF THE PRESENTLY PREFERRED EMBODIMENT

With initial reference to FIG. 1, slotted rotary shaver 10 is illustrated according to one embodiment of the present invention. Slotted rotary shaver 10 is comprised of body portion 12 and shaving portion 14 having a removable shaving cover portion cover 16. Shaving portion 14 is provided with upper rotary head assemblies 18 positioned thereon. Although FIG. 1 illustrates three rotary head assemblies 18 positioned on shaving portion 14, the invention is not limited in this respect and any number of rotary shaving head assemblies 18 may be provided.

Shaver 10 is electrically-powered and is advantageously provided with a conventional dual directional multi-vibrating high sonic motor (not shown) which alternately rotates clockwise and counter clockwise, which may be re-chargeable, and which is positioned internally within body portion 12 proximate shaving portion 14. The motor may be powered by one or more internally disposed batteries, or the shaver 10 may be provided with an electrical cord (not shown) for plugging into a household A/C outlet. An alternate model of the shaver may comprise a single direction 7,000–10,000 RPM motor with a manual reversing motor. The motor includes one or more shafts 22 (shown in FIG. 5) which correspond to the number of rotary shaving head assemblies 18 provided on shaving portion 14. Shaver 10 may be operated directly off the batteries or the A/C outlet, or may be capable of running off a stored charge which accumulates through the use of a charger (not shown) when shaver 10 is not in use. An "ON/OFF" switch 20 for activating shaver 10 is advantageously disposed on body portion 12. Other switches (not shown), such as for speed control of rotary shaver head assemblies 18, may be disposed on body portion 12 along with indicator lights (not shown) or LCD displays which may indicate, for example, when shaver 10 is activated and/or when it is in a charging mode.

As illustrated in FIGS. 1 and 2, rotary shaving head assembly 18 is comprised of an upper slotted grid 24 which is fixed or stationary, and a lower rotary grid 26 (shown in FIG. 5). The stationary slotted fixed grid 24 is comprised of fine stainless steel screen or stamped or mesh etched material provided with a plurality of circular apertures 28 disposed thereon. This plurality of grid apertures 28 comprises a large surface area for efficiently cutting shorter stubble hairs. Fixed upper grid 24 and lower rotary grid 26 are advantageously closely paired and spaced through an opposite magnetized polarity between the fixed upper grid 24 which is positively charged, and a lower rotatary grid 26, which is negatively charged, thus causing magnetic attraction and scissoring action at the tightly spaced cutting interface between upper grid 24 and lower rotary grid 26. It is to be understood that although slotted fixed grid 24 is illustrated as circular in grid configuration, the invention is not limited in this respect and other geometric grid shapes such as square or triangular shaving geometries of various sizes may be substituted into slotted fixed grid 24.

As shown in FIG. 1 and more closely in FIG. 2, upper fixed grid 24 of shaving portion 14, is advantageously divided into four pie-shaped sharpened cutting quadrants 30*a*, 30*b*, 30*c*, and 30*d*. As illustrated in FIG. 2 and in FIG. 4, which shows a single enlarged quadrant 30*b* having first and second straight edges 32*a* and 32*b*, respectively arranged 90° from each other. It is understood that although only quadrant 30*b* is illustrated in FIG. 4, each of the other three quadrants 30*a*, 30*c* and 30*d* are also provided with respective first and second straight edges 32*a* and 32*b*. First and second straight edges 32*a* and 32*b* consist of finely sharpened blades 34*a* and 34*b* mounted to edges 32*a* and 32*b*, respectively. First and second blades 34*a*, 34*b* are stamped out from a circular stainless steel screen separately razor sharpened at 32*a* and 32*b* and then reassembled back into the total fixed grid 24. Each rotary head thus comprises first and second edges 32*a*, 32*b* of all quadrants 30*a*, 30*b*, 30*c* and 30*d* so that first and second blades 34*a* and 34*b* of any one quadrant are diametrically opposite to first and second blades 34*a*, 34*b* of its adjoining quadrant. These diametrically opposite facing blades 34*a* and 34*b* in FIG. 3 define slot 38 into which hairs protrude when upper grid 24 is placed against a user's skin. Quadrants 30*a*, 30*b*, 30*c* and 30*d* are held together at a central pivot point 36 which permits rotation of rotary grid 26 underneath upper grid 24.

Slot 38, which is further illustrated in FIG. 2, and which exists between the diametrically opposite first and second blades 34*a*, 34*b* of each quadrant 30*a*, 30*b*, 30*c* and 30*d*, is advantageously of a width equivalent to 3–5 hairs. The width of slot 38 is such that long and curly facial or body hairs may protrude into slot 38 when shaving portion 14 of shaver 10 is placed against a user's skin, thus providing the user with a shave of blade-to-face closeness. FIG. 3 illustrates an enlarged view of slot 38 positioned between a first blade 34*a* of one of quadrants 30*a*, 30*b*, 30*c* or 30*d*, and its diametrically opposite second blade 34*b* of a subsequent quadrant 30*a*, 30*b*, 30*c* or 30*d*. Since first and second blades 34*a*, 34*b* are positioned diametrically opposite each other to define slot 38 having a width of approximately 3–5 hairs, cuts and nicks are prevented since slot 38 is of a size which allows hair to protrude thereinto, while preventing skin from entering. It is understood that upper grid 24 is not limited to four pie-shaped quadrants 30*a*, 30*b*, 30*c*, 30*d*, and may also comprise three or more sections separated by slots defined by diametrically opposite sharpened blades.

FIG. 5 illustrates the lower rotary grid 26, which may be and which is advantageously positioned tightly below upper fixed rotary grid 24 on motor shaft 22 in the same plane therewith, as shown in FIG. 6. Lower rotary grid 26 is preferably a flexible, thin stainless steel or metallized mylar material having a coating to reduce friction. As illustrated in FIG. 5, a plurality of diamond shaped openings 40 are positioned about the entire circumference of lower rotary grid 26 and through which hair may protrude when shaving portion 14 of shaver 10 is placed against a user's skin. When shaver 10 is activated, lower rotary grid 26 rotates below upper grid 24 to create a scissoring action which cuts long and curly hairs which extend through apertures 28 and slots 38 on upper grid 24, and thorough openings 40 in lower rotary grid 26.

Openings 40 are advantageously provided with micro-serrated or sawtooth edges 424 for slicing any hairs at skin level which protrude through openings 40 when shaving portion 14 of shaver 10 is placed against a user's skin. It is understood that the lower rotary grid 26 is not limited to diamond shaped openings 40, however, and openings 40 may be oval, triangular or any other geometric shape instead. A spring (not shown) may be disposed between upper fixed grid 24 and lower grid 26 on motor shaft 22, such that upper rotary grid 18 may compress against lower grid 42 when head 14 of shaver 10 is pressed against a user's skin. While positioned on motor shaft 22, upper grid 24 and lower rotary grid 26 are planerized through opposite magnetized polarity such that when shaver 10 is activated, lower rotary grid 26 alternately moves in clockwise and counter clockwise directions at adjustable high sonic frequencies using a multi vibrating shaft 22 motor so as to provide efficient scissor-like cutting of the short stubble hair which protrudes through apertures 28 organized in a large efficient active cutting surface area of upper fixed grid 24, and close to the face cutting of long and curly hairs through slots 38 on upper grid 24 and openings 40 on lower rotary grid 26.

It is understood that the invention is not limited to a dual directional multi vibrating high sonic speed, however such motor is advantageous since it provides for the dual clockwise and counterclockwise alternative direction of lower rotary grid 26 and its continuous reversal at high sonic speeds. The ability to reverse the direction of high lower rotary grids 26, extends the life of upper grids 24 and lower rotary grids 26, as well as the sharpness and cutting life of first and second blades 34*a*, 34*b* which define slots 38 between the adjoining quadrants 30*a*, 30*b*, 30*c* and 30*d* of upper fixed grid 24 of each rotary shaving head 18.

Shaving portion cover 16 which is disposed on shaving portion 14 is removable and may be separated from shaving portion 14 to permit easy cleaning of the rotary shaving heads 18. Furthermore, first and second blades 34*a*, 34*b* which make up slots 38 may be sharpened using conventional razor blade sharpening methods or the entire rotary grid may be removed and replaced altogether.

In use, shaver 10 is activated by switching switch 20 to the "ON" position. When shaver 10 is activated, the lower grids 26 alternately rotate upon motor shaft 22 in clockwise and counterclockwise directions continually reversing at high sonic speed. Head 14 of shaver 10 is then placed against a user's skin with only enough pressure to allow the upper grids 24 to press against a user's skin so that the smaller stubble protrudes through apertures 28 on upper grids 24, while long/curly hair and stubble, enter sharpened slots 38 and through openings 40 of the lower rotary grids 26. As stubble hairs protrude through apertures 28 on upper fixed grids 24, slots 38 and openings 40 on lower grids 26, upper fixed grid 24 and lower rotary grid 26 compress against each other driven by motor shaft 22 in alternate, continually reversing clockwise and counter clockwise directions continually reversing at high sonic speeds, as they are spinning at a high RPM such that upper rotary grid 24 and lower grid 26 create a scissoring effect whereby the hairs protruding through apertures 28 on upper fixed grids 24, sharpened slots 38 and openings 40 on lower rotary grids 26 are sliced away from the user's skin. Although sharpened slots 38 are comprised of blades 34*a*, 34*b*, the width of slots 38 are so close that shaver 10 is capable of cutting near skin level thereby providing the user with a shave as close as that achieved with a hand-held razor, yet with the comfort, cleanliness and safety of an electric shaver.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirt of the invention. It is to be understood that the drawings are not necessarily drawn to scale, but that they are merely conceptual in nature.

What is claimed is:

1. A rotary shaver, comprising:

a body portion; and a shaving portion connected to said body portion, said shaving portion having at least one rotary shaving head, said rotary shaving head comprising a fixed upper slotted grid fixed to said shaving portion, a lower rotary grid, said lower rotary grid proximate said upper grid, said upper slotted grid comprising at least two quadrants, said quadrants separated by a slot which is provided with first and second blade edges.

2. The rotary shaver of claim 1, wherein said lower rotary grid is mounted on a motor shaft and comprises a plurality of openings, said upper slotted grid comprising at least two slot openings between each said at least two quadrants.

3. The rotary shaver of claim 1, wherein the upper slotted grid is stationary, said upper slotted grid comprised of a fine stainless steel screen with a plurality of apertures disposed thereon.

4. The rotary shaver of claim 1, wherein the upper slotted grid is provided with a plurality of grid hole apertures thereon.

5. The rotary shaver of claim 4, wherein said apertures are circular.

6. The rotary shaver of claim 1, wherein said upper grid and said lower rotary grid are maintained in frictional contact by a spring force on said motor shaft by an opposite magnetized polarity, said upper grid being positively charged and said lower rotary grid being negatively charged for causing magnetic attraction and scissoring action at the interface between said upper grid and said lower rotary grid.

7. The rotary shaver of claim 1, wherein said quadrants are held together at a central pivot point.

8. The rotary shaver of claim 1, wherein said first and second blades are sharpened using conventional razor blade sharpening methods.

9. The rotary shaver of claim 1, wherein said lower rotary grid is composed of a flexible, stainless steel material.

10. The rotary shaver of claim 9, wherein said lower rotary grid contains a plurality of openings.

11. The rotary shaver of claim 1, wherein said lower rotary grid moves alternatively in clockwise and counter clockwise directions at adjustable high sonic frequencies, and wherein said motor shaft is a multi vibrating motor shaft.

12. The rotary shaver as claimed in claim 1, wherein electric power is supplied by recharable batteries.

13. The rotary shaver as claimed in claim 1, wherein said first and second blades are etched onto the edges of a circular stainless steel screen.

14. The rotary shaver as claimed in claim 1, wherein said upper slotted grid is comprised of four quadrants.

* * * * *